US007748893B2

(12) United States Patent
Yaniv et al.

(10) Patent No.: US 7,748,893 B2
(45) Date of Patent: Jul. 6, 2010

(54) MAGNETIC STIRRING ARRANGEMENT

(75) Inventors: Abraham Yaniv, Tel Aviv (IL); Arnona Gazit, Tel Aviv (IL); Paul Thom, Butler, NJ (US); David Landsberger, Caldwell, NJ (US); Frances Gomes, Lincoln Park, NJ (US)

(73) Assignee: Bel-Art Products, Inc., Pequannock, NJ (US)

( * ) Notice: Subject to any disclaimer, the term of this patent is extended or adjusted under 35 U.S.C. 154(b) by 1020 days.

(21) Appl. No.: 11/355,026

(22) Filed: Feb. 14, 2006

(65) Prior Publication Data

US 2007/0189115 A1 Aug. 16, 2007

(51) Int. Cl.
*B01F 13/04* (2006.01)

(52) U.S. Cl. ..... 366/273; 417/420

(58) Field of Classification Search ..... 366/273, 366/274; 416/3; 417/420
See application file for complete search history.

(56) References Cited

U.S. PATENT DOCUMENTS

| | | | | | |
|---|---|---|---|---|---|
| 2,941,477 | A | * | 6/1960 | Dalton | 417/420 |
| 3,575,536 | A | * | 4/1971 | Jacobs et al. | 417/420 |
| 3,749,369 | A | | 7/1973 | Landsberger | |
| 4,266,914 | A | * | 5/1981 | Dickinson | 417/63 |
| 4,759,635 | A | | 7/1988 | MacMichael et al. | |
| 4,797,005 | A | | 1/1989 | Landsberger | |
| 5,141,327 | A | | 8/1992 | Shiobara | |
| 5,269,664 | A | | 12/1993 | Buse | |
| 5,352,036 | A | | 10/1994 | Haber et al. | |
| 5,399,074 | A | | 3/1995 | Nose et al. | |
| 5,435,692 | A | | 7/1995 | Kidger et al. | |
| 5,470,208 | A | * | 11/1995 | Kletschka | 417/356 |
| 5,599,175 | A | * | 2/1997 | Tojo et al. | 417/420 |
| 5,899,567 | A | | 5/1999 | Morris, Jr. | |
| 6,076,957 | A | | 6/2000 | Gomes | |
| 6,296,459 | B1 | | 10/2001 | Saputo et al. | |
| 6,337,024 | B1 | | 1/2002 | Hammonds | |
| 6,439,845 | B1 | | 8/2002 | Veres | |
| 6,464,387 | B1 | | 10/2002 | Stogsdill | |
| 6,663,276 | B2 | | 12/2003 | Yale | |
| 6,733,171 | B2 | | 5/2004 | Schob | |
| 6,899,454 | B2 | | 5/2005 | Terentiev | |
| 7,186,018 | B2 | * | 3/2007 | Burak | 366/273 |
| 2001/0055240 | A1 | * | 12/2001 | Bruno et al. | 366/274 |

FOREIGN PATENT DOCUMENTS

| | | |
|---|---|---|
| GB | 884113 | 7/1960 |
| WO | WO 2006/120945 | 11/2006 |

OTHER PUBLICATIONS

Bel-Art Products, Inc. catalog 204 , 2004, pp. 145-153.

* cited by examiner

*Primary Examiner*—David L Sorkin
(74) *Attorney, Agent, or Firm*—Lowenstein Sandler PC

(57) ABSTRACT

An enclosed magnetic stirring bar arrangement includes a housing formed by front and rear walls interconnected by a peripheral wall, so as to define a substantially hollow interior chamber within said housing. An operational opening is formed within the front wall and at least one discharging aperture is provided in the peripheral wall. A magnetic stirring member is movably positioned within the substantially hollow interior chamber, whereby rotational motion of the magnetic stirring member facilitates entering a liquid into the substantially hollow interior chamber and discharging the liquid from the interior chamber through the at least one discharging aperture.

12 Claims, 4 Drawing Sheets

MAGNETIC STIRRING ARRANGEMENT

FIELD OF THE INVENTION

This invention relates in general to magnetic stirring devices, and in particular, it relates to magnetic stirring arrangements capable of providing localized and/or concentrated stirring action.

BACKGROUND OF THE INVENTION

Magnetic stirring bars are useful in clinics, medical laboratories, research laboratories, and other similar facilities wherein it is necessary to stir solutions or specimens. Such magnetic stirring bars generally include a permanent magnet designed such that the magnetic pole axis is oriented substantially horizontally across the bar. The bar is typically positioned in a beaker, flask, or other similar containers containing a solution or specimen to be stirred. The container is typically placed on a conventional magnetic stirrer which provides a magnetic field for rotating the stirring bar and to stir the solution or specimen.

When liquid to be stirred is situated in a container with gels and other similar sensitive substances, conventional prior art stirring bar devices are often too harsh for sensitive gel structures. For example, it is not uncommon for the magnetic stirring bar positioned in a solution above a gel to bore a hole or break apart the gel into small fragments, when it is spun by a magnetic field. Thus, the sensitive nature of the gel structure can be seriously damaged or destroyed through the violent rotation of the magnetic stirring bar. This makes the use of such prior art stirring devices to be undesirable, especially when the integrity of the gels or other chemical or biological sample must be maintained.

Furthermore, applying an external rotating magnetic field to create free rotation of the magnetic stirring device causes mixing or stirring action of the entire volume of the solution, liquid, or other fluid surrounding the stirring bar. The efficiency of the stirring action is sometimes compromised in view of the uncontrolled flow and broad nature of the stirring magnet operation. Use of such conventional prior art devices is not always desirable, especially when the stirring action should be directed to a substantially limited area or region of a chemical or biological sample.

It has been therefore a long felt and unsolved need for a magnetic stirring arrangement capable of providing a gentle stirring action which does substantially effect the integrity of the substances exposed to the stirring process. There is also a need for a stirring device or arrangement capable of providing a stirring action directed to a substantially limited area or region of the solution or liquid, a device which is simple in use, inexpensive to manufacture, and can be easily cleaned and/or sterilized, so as to avoid undesirable contamination.

SUMMARY OF THE INVENTION

This invention utilizes a magnetic stirring bar arrangement enclosed in a non-reactive plastic enclosure having a single operational in-take for evenly sucking a liquid or gel while expelling said liquid or gel through diffusion vanes. The top and rear surfaces of the device are substantially flat while the peripheral surface of the device is substantially rounded and contains diffusion vanes equi-spaced around the equator of the device. The stirring force of the magnetic rod and the substantially closed configuration of the device allow for smooth stirring of a liquid, solution, or gel which will not destroy such substances. The configuration further allows for further and more even mixing than unenclosed conventional stirring rods by creating smooth jets to propel the substances.

Accordingly, the present invention relates to a magnetic stirring bar arrangement which solves the aforementioned problems encountered in mixing liquids in a laboratory. The object of the present invention is to provide an inexpensive, magnetic stir bar movably positioned inside an enclosure having an operational fluid in-take positioned at the top, relative to its placement inside a fluid or gel-filled cavity, and a series of diffusion vanes.

One aspect of the invention provides an enclosed magnetic stirring bar arrangement, comprising, a housing formed by front and rear walls interconnected by a peripheral wall, so as to define a substantially hollow interior chamber within said housing. The front wall has an operational opening, at least one discharging aperture within the peripheral wall, and a magnetic stirring member movably positioned within the substantially hollow interior chamber. During the rotational motion of the magnetic stirring member a liquid enters into the substantially hollow interior chamber and is discharged from the chamber through the at least one discharging aperture. Upon rotation of the magnetic stirring member a low pressure zone is formed at the operational opening facilitating entry of the liquid into the substantially hollow interior chamber. Rotational motion of the magnetic stirring member further generates a high pressure zone within the cavity of the device and causes ejection of the liquid from the substantially hollow interior chamber through the at least one discharging aperture.

As to another aspect of the invention, the operational opening is formed within a central region of the front wall. The at least one discharging aperture comprises a plurality of discharging apertures formed within the peripheral wall.

As to a further aspect of the invention, the magnetic stirring member is in the form of an impeller driven by a magnetic driver positioned outside of said housing. The magnetic driver includes a magnetic actuator so that said magnetic impeller is magnetically responsive to the magnetic actuator for rotation therewith.

Still another aspect of the invention provides a method of mixing or stirring a liquid by means of a magnetic stirring arrangement having a housing formed by front and rear walls interconnected by a peripheral wall defining a substantially hollow interior chamber, the front wall having an operational opening and at least one discharging aperture formed within the peripheral wall. The magnetic stirring member is positioned within the substantially hollow interior chamber. The method consists of the following steps: providing a container having a wall structure defining an inner volume containing a liquid; positioning the magnetic stirring arrangement into the inner volume; activating the magnetic field generating element to cause rotation of the magnetic stirring member within the interior chamber; entering the liquid from the inner volume into the substantially interior chamber through the operational opening; stirring the liquid within the substantially hollow interior chamber by the rotating stirring member; and discharging the mixed liquid from the interior chamber.

As to still further aspect of the invention, the rear wall of said housing is substantially solid, and in the step of positioning of the magnetic stirring arrangement, the substantially solid rear wall is oriented to face the magnetic field generating element and the front wall with the operational opening oriented to face away from the magnetic field generating element. In the activating step, upon rotating the magnetic stirring member a low pressure zone is developed at the operational opening facilitating the entering step. In the discharging step the liquid is discharged from the substantially hollow interior chamber through the at least one discharging aperture.

DESCRIPTION OF THE PREFERRED EMBODIMENT

Figure 1:
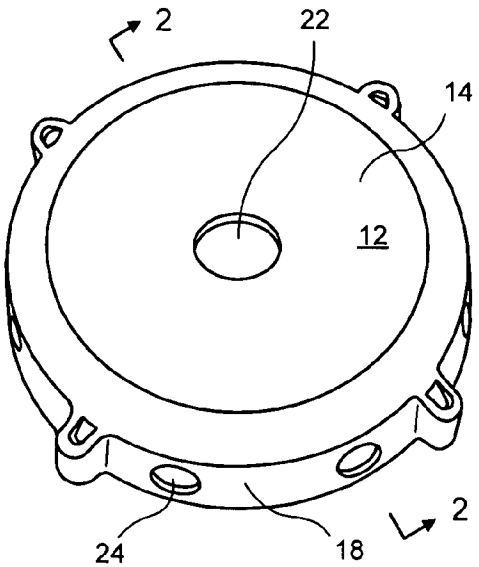
FIG. 1 is a semi-perspective view showing one embodiment of the magnetic stirring arrangement of the invention.
Figure 2:
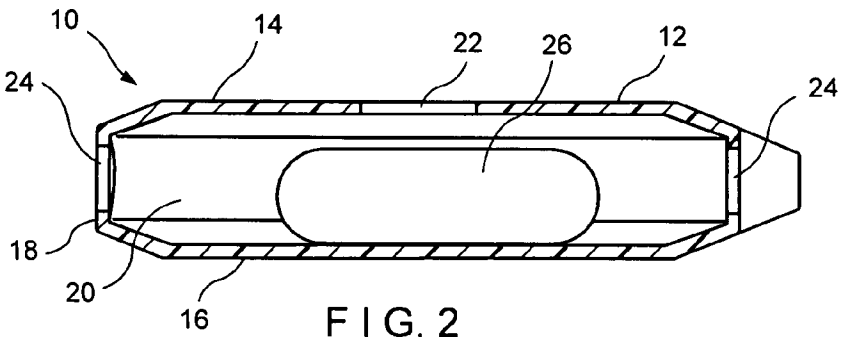
FIG. 2 is a sectional view according to section line 2-2 of FIG. 1.
Figure 4:
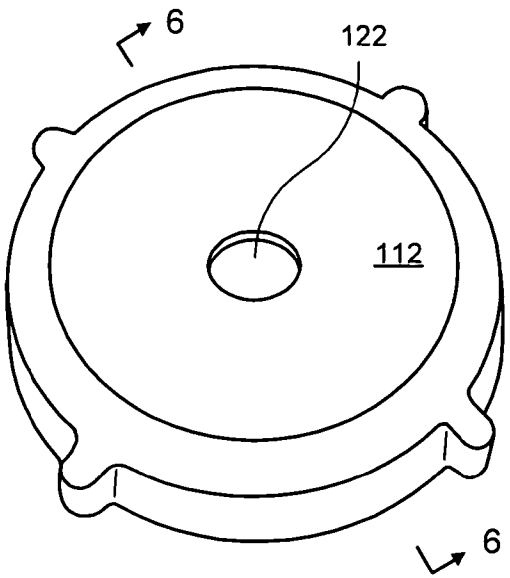
FIG. 4 is a top-perspective view illustrating the magnetic stirring device according to another embodiment of the invention.
Figure 6:
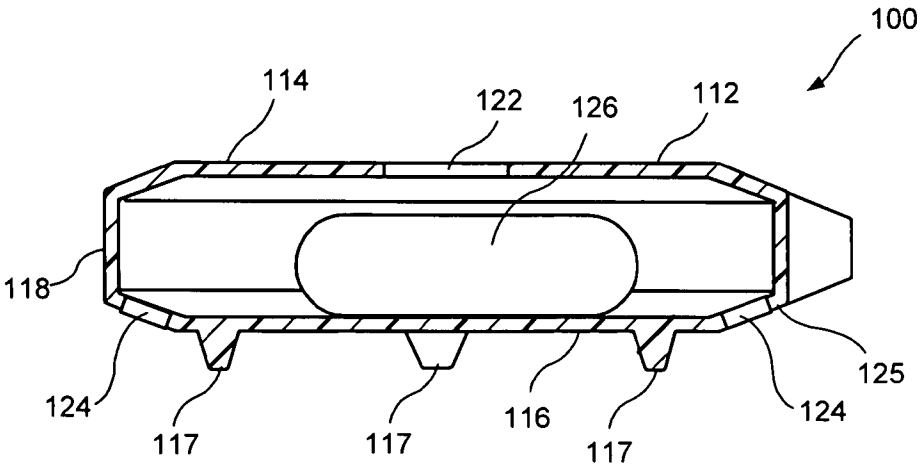
FIG. 6 is a sectional view according to section line 6-6 of FIG. 4.
Figure 5:
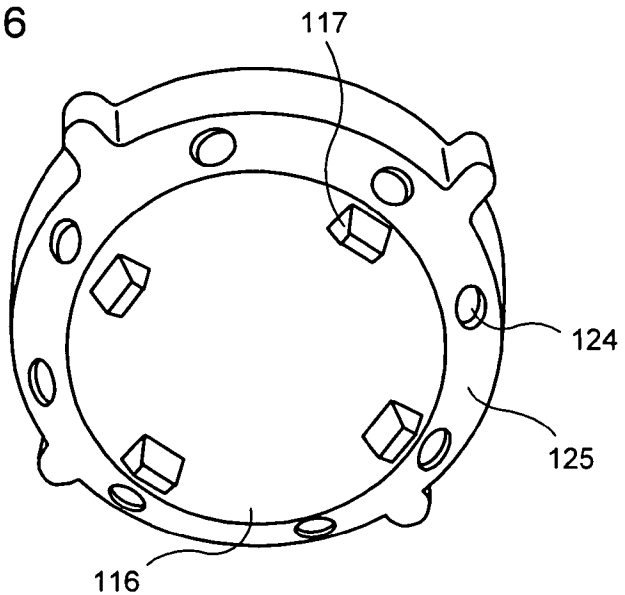
FIG. 5 is a semi-perspective bottom view thereof.

Referring now to the drawings in general and to FIG. 1, specifically showing a magnetic stirring arrangement 10 of the invention. The stirring arrangement consists of a housing 12, which is typically formed by front 14 and rear 16 walls interconnected by a peripheral wall 18, so as to define a substantially hollow interior chamber 20 therebetween. In the preferred embodiment of the invention an operational opening or a fluid inlet 22 is formed within the front wall 14, preferably in the central area thereof, whereas the rear wall 16 is substantially solid. Typically, the operational opening or the fluid inlet 22 is formed having substantially circular configuration with a sufficient diameter so as to allow for smooth entry of a fluid into the interior chamber 20. However, other configurations of the operational opening 22 are within the scope of the invention.

It is recommended to provide a plurality of the discharging apertures or outlets 24 within the peripheral wall 18 which may be equally spaced from each other. On the other hand, an embodiment with a single or at least one outlet aperture 24 is also within the scope of the invention. The housing is typically made from a plastic material having substantial weight. This is necessary to facilitate submerging of the arrangement into the liquid which is being stirred. The plastic material may be easily autoclaved and/or sterilized. A magnetic stirring member or driven portion 26 is movably positioned within the interior chamber 20 between the front 14 and rear 16 walls.

In one embodiment, the magnetic stirring member or driven portion 26 is an elongated permanent magnet which is designed such that the magnetic pole axis is oriented across the bar and is encapsulated in a sheath made preferably of an inert, low-friction material such as a polymer. The magnetic stirring member 26 may be fabricated from any magnetizable material such as ferrous oxides, still rare earth elements, magnetic agents intermixed with a rubber matrix material, or any equivalent thereof. The configuration and size of the magnetic stirring member are selected in such a manner, so as to create sufficient turbulence when rotationally moved within the substantially hollow interior chamber 20.

Figure 3:
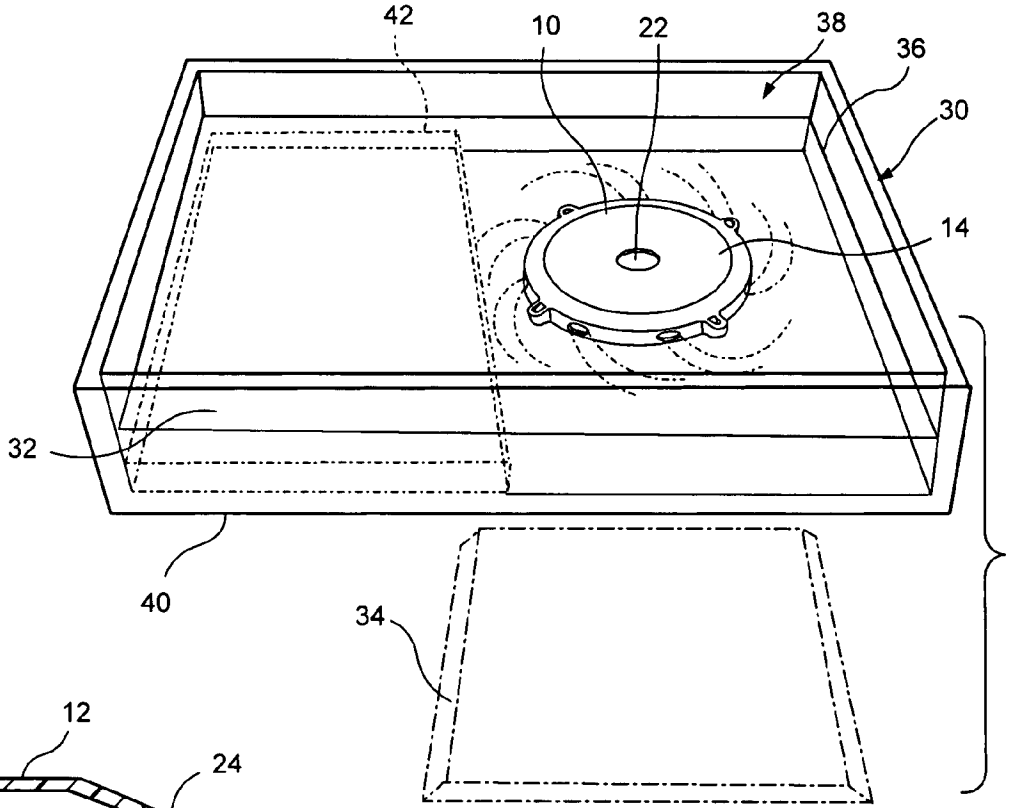
FIG. 3 is a view illustrating use of the magnetic stirring device of FIG. 1.

In use, as illustrated in FIG. 3, the magnetic stirring arrangement 10 is typically placed in a container 30 having a wall structure 32 defining an inner volume 38 at least partially filled with a liquid 36. The magnetic stirring arrangement 10 can be positioned in the vicinity of a gel 42 or similar substance situated at a bottom wall 40 of the container. As illustrated in FIG. 3, in this position, the front wall 14 of the housing having the inlet opening 22 faces away from the bottom wall 40 of the container and the gel 42, whereas the substantially solid rear wall 16 is positioned, so as to face the bottom wall 40. Gravitational forces cause initial filling of the interior chamber 20 with the solution or liquid 36 to be stirred.

A driving magnetic portion 34 (shown in dotted lines) is also provided, to rotate the magnetic stirring member or a driven magnetic portion 26. The housing 12 containing the magnetic stirring member 26 is placed at the bottom 40 of the container 30 which is disposed over the driving portion 34. In use, the driving magnetic portion transmits rotary motion without direct contact between the driving magnetic portion and the driven magnetic portion or stirring member 26. The driving magnetic portion creates a magnetic field which passes through the walls 32, 40 of the container, the housing 12 as well as the interior volume of the fluid 36. The magnetic stirring member 26 is magnetically interactive with this magnetic field, so as to cause rotational motion thereof within the interior chamber 20.

Upon rotational motion of the magnetic stirring member 26, a low pressure zone is being formed at the inlet opening 22, causing suction of the liquid into the interior chamber 20. After being thoroughly stirred, in view of the centrifugal forces generated by the rotational motion of the member 26, the liquid is discharged from the interior chamber 20 through at least one or multiple discharging apertures 24 to the interior 38 of the container, so ad to be smoothly directed towards the gel 42. In the invention, the magnetic stirring member 26 is spun by magnetic forces and converts these forces into kinetic energy in the liquid by accelerating the liquid to the outer periphery of the interior chamber 20. The magnetic stirring member 26 acts as an impeller to create a low pressure zone at the area of the inlet opening 22 to thereby constantly drawing liquid into the hollow interior chamber 20 and ejecting the liquid out through a series of discharging apertures 24.

In the apparatus of the invention, the rotational motion of the magnetic stirring member 26 and the stirring or mixing of the liquid resulted therefrom is localized and concentrated substantially within the area of the hollow interior chamber 20. The stirring action practically does not extend beyond the walls of the housing 12 and is gentle enough, so as not to affect the gel 42 or other substances disposed outside of the housing within the container. The discharging apertures 24 enable the invention to direct the concentrated kinetic energy created by the stirring member 26, so as to discharge the stirred liquid from the interior chamber 20 in the form of multiple streams at least some of which are oriented towards the surface of the gel 42.

In this manner, the discharged streams of the stirred liquid are directed to a specific region of the liquid 36 within the inner volume 38, so as to be directed at a specific region of the gel or the like 42. By moving the stirring device 10 from one area of the container to another or rotating the housing 12 about its axis, the area covered by the concentrated discharged streams of the liquid stirred within the interior chamber 20 can be adjusted. This action results in concentrated, more uniform delivery of the stirred liquid to the required predetermined location, than previously possible. This occurs with less agitation, as is required in delicate stirring procedures.

The plurality of discharging apertures placed strategically around the peripheral areas of the device provides further reaching, gentler, and more uniform stirring action than similarly sized magnetic stirring bars. Liquid is smoothly jettisoned axially or radially outwards into the liquid filled chamber and does not harm the sensitive gel structure situated within the path of the jettisoned liquid streams. This is especially so, compare to the prior art, utilizing isolated magnetic bars, where the stirring action imparted to a liquid is not always controllable with respect to the covered area and discharged to the culture medium or gel and sometimes is violent enough to destroy the viability or usability of these substances. In the apparatus of the invention the cross-sectional area of the streams is decreased and the velocity of such streams is increased, compare to a similar magnetic stirring members without an enclosure.

Figure 7:
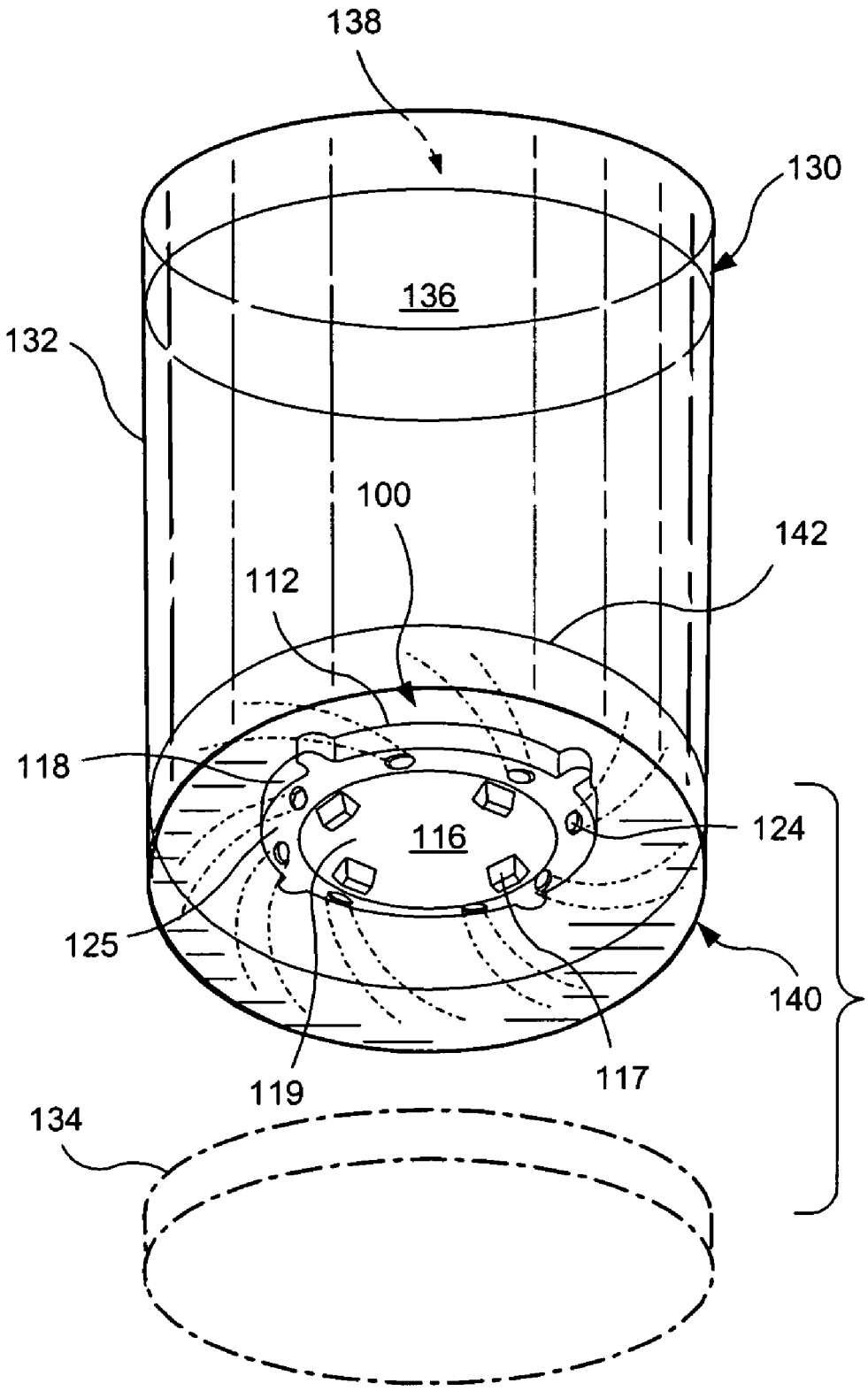
FIG. 7 is a semi-perspective view illustrating use of the magnetic stirring device of FIGS. 4-6.
Figure 8:
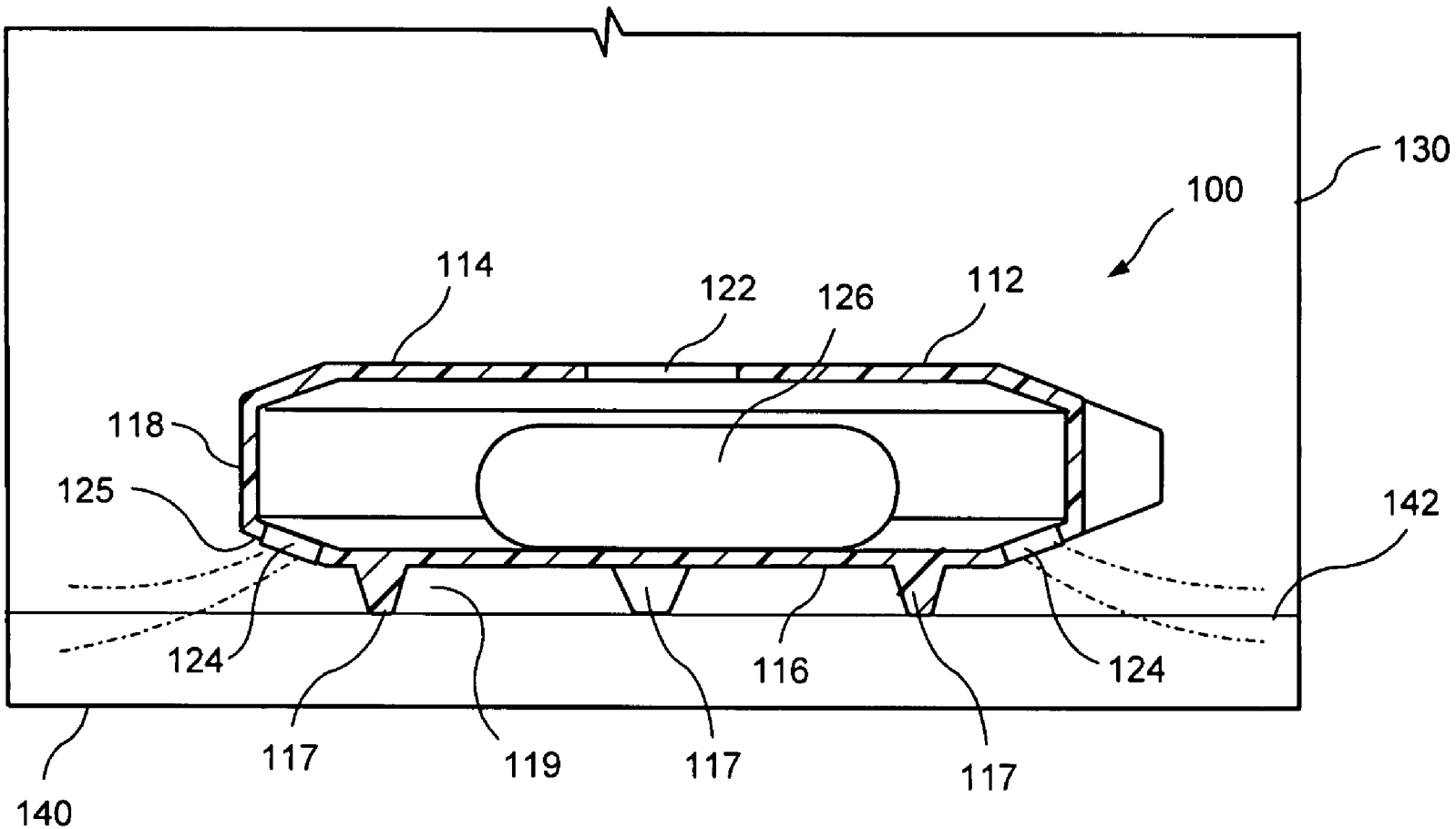
FIG. 8 is a partially sectional view illustrating use of the magnetic stirring device of FIGS. 4-6.

Turning now to FIGS. 4-7 showing another embodiment of the invention. The magnetic stirring arrangement 100 consists of the housing 112 which is formed by the front 114 and rear 116 walls interconnected by peripheral wall 118. Similar to the previously discussed embodiment, the operational opening of fluid inlet 122 is provided with the central area of the top wall. The supportive legs 117 extend outwardly from the rear wall 116. At least one or multiple discharging apertures or outlets 124 are formed in the area of junction region 125 between the rear wall 116 and the peripheral wall 118. The junction region 125 can be positioned at an angle to the rear wall 116. As illustrated in FIGS. 7 and 8, in use, the magnetic stirring device 100 is positioned within the container 130 having a wall structure 132 defining an inner volume 138 having liquid 136, so that the rear wall 116 of the housing is spaced from the bottom wall 140 of the container and/or top surface of the gel 142 by a gap 119. In this manner, upon activation of the stirring member 126 by means of the driving portion 134, the streams of the stirred liquid ejected from the discharging apertures 124 are directed to the gap 119. Thus, the streams of the stirred liquid can be disposed directly at the top surface of the gel 142.

In the present invention, the magnetic stirring device is situated at a predetermined location in the vicinity of a gel or other sensitive substance. The device of the invention can also be positioned on top of the gel. In this instance, the gel is capable of supporting the relatively light weight of the device. Thus, the magnetic stirring member is isolated from the sensitive gel by the solid rear wall of the housing. In this manner, enough turbulence is created to thoroughly stir the liquid within the interior chamber 20, 120 without damaging the sensitive gel or any other sensitive components in the container. In this embodiment the rear wall of the housing serves as a base which distributes the mass of the magnetic stirring member and the entire stirring device over the bottom surface of the container 40, 140 or a relatively larger area of a gel 42, 142 so as to be stably positioned and minimize movement which could damage a sensitive structure such as a gel.

The device of the invention is neither expensive nor requires the purchase of additional laboratory equipment. As such, the device is compatible with currently available magnetic stirring apparati, and has a greater and gentler stirring force than products currently on the market to allow for solutions to be mixed into gels without disrupting the gel.

While the above provides a full and complete disclosure of the preferred embodiment of the invention, modifications may be constructed by those skilled in the art. For example, while the housing has been illustrated as having a rectangular or cylindrical configuration, other geometries such as elliptical, irregular shapes, and the like may be employed as desired. Although, the housing 12, 112 has been illustrated as having a unitary structure, other forms of the housing are also contemplated. For example, the housing may consist of at least two front and rear parts joined together at the central region thereof. Further, although the magnetic stirring member has been illustrated as having an elongated configuration, other geometrical shapes can be employed. For example, the magnetic stirring member can be in the form of an impeller or other similar configurations. In addition, other arrangements may be used to provide the rotational motion of the magnetic stirring member within the housing. Therefore, the above description should not be construed as limiting the scope of the invention which is defined by the appended claims.

What is claimed is:

1. An enclosed magnetic stirring bar arrangement, comprising:

a housing comprising:

a front and rear walls interconnected by a peripheral wall, so as to define a substantially hollow interior chamber within said housing, a plurality of supportive legs extending outwardly from the rear wall and defining a path configured to accommodate a medium, an operational opening situated within the front wall, and at least one discharging aperture formed in a junction region between the rear wall and the peripheral wall; and a magnetic stirring member being movably positioned within the substantially hollow interior chamber, whereby rotational motion of the magnetic stirring member facilitates entering a liquid into the substantially hollow interior chambers and discharging the liquid from the interior chamber through the at least one discharging aperture.

2. The magnetic stirring arrangement according to claim 1, wherein rotation of the magnetic stirring member causes low pressure zone formation at the operational opening facilitating entry of the liquid into the substantially hollow interior chamber and causes formation of a high pressure zone within the interior chamber causing ejection of the liquid through the at least one discharging aperture.

3. The magnetic stirring arrangement according to claim 1, wherein the operational opening is formed within a central region of the front wall.

4. The magnetic stirring arrangement according to claim 3, wherein the at least one discharging aperture comprises a plurality of discharging apertures formed within the junction region.

5. The magnetic stirring arrangement according to claim 4, wherein the plurality of discharging apertures are equidistantly spaced within the junction region.

6. The magnetic stirring arrangement according to claim 1, wherein said magnetic stirring member is a magnetic impeller driven by a magnetic driver positioned outside of said housing.

7. The magnetic stirring arrangement according to claim 6, wherein the magnetic driver includes a magnetic actuator, so that said magnetic impeller is magnetically responsive to the magnetic actuator for rotation therewith.

8. The magnetic stifling arrangement according to claim 4, wherein the plurality of discharging apertures wall are substantially circular in shape.

9. The magnetic stirring arrangement according to claim 8, wherein the magnetic arrangement is positioned within a container having a wall structure defining an inner volume in such a manner that the bottom wall of the housing is spaced from the wall structure defining a gap therebetween, so that the stirred liquid is ejected from the discharging apertures into the gap.

10. The magnetic stirring arrangement according to claim 1 wherein said junction region is positioned at an angle to the rear wall.

11. The magnetic stirring arrangement according to claim 10 wherein said apertures are positioned at said angle towards the legs.

12. The magnetic stirring arrangement according to claim 1 wherein said rear wall comprising a substantially conical region and said legs are placed inwards of said substantially conical region.

* * * * *